United States Patent [19]

Brown et al.

[11] 4,121,626

[45] Oct. 24, 1978

[54] WATER JET LOOM

[75] Inventors: Robert Saul Brown; James Roy Johnson, both of Spartanburg, S.C.

[73] Assignee: Milliken Research Corporation, Spartanburg, S.C.

[21] Appl. No.: 857,084

[22] Filed: Dec. 5, 1977

[51] Int. Cl.[2] ..... D03D 47/32

[52] U.S. Cl. ..... 139/435

[58] Field of Search ..... 139/435; 226/7, 97, 226/95

[56] References Cited

U.S. PATENT DOCUMENTS 3,476,155 11/1969 Carothers ..... 139/435

FOREIGN PATENT DOCUMENTS 24,186 6/1974 Japan ..... 139/435

*Primary Examiner*—Henry S. Jaudon

*Attorney, Agent, or Firm*—Robert S. Alexander; H. William Petry

[57] ABSTRACT

A water jet loom having means for forming a shed including heddles upon which warp yarns are mounted, a weft inserting jet for inserting weft yarns into the shed, a stainless steel reed for beating the weft yarns into the apex of the shed and means for supplying alkaline feed water to the weft inserting jet is disclosed.

5 Claims, 1 Drawing Figure

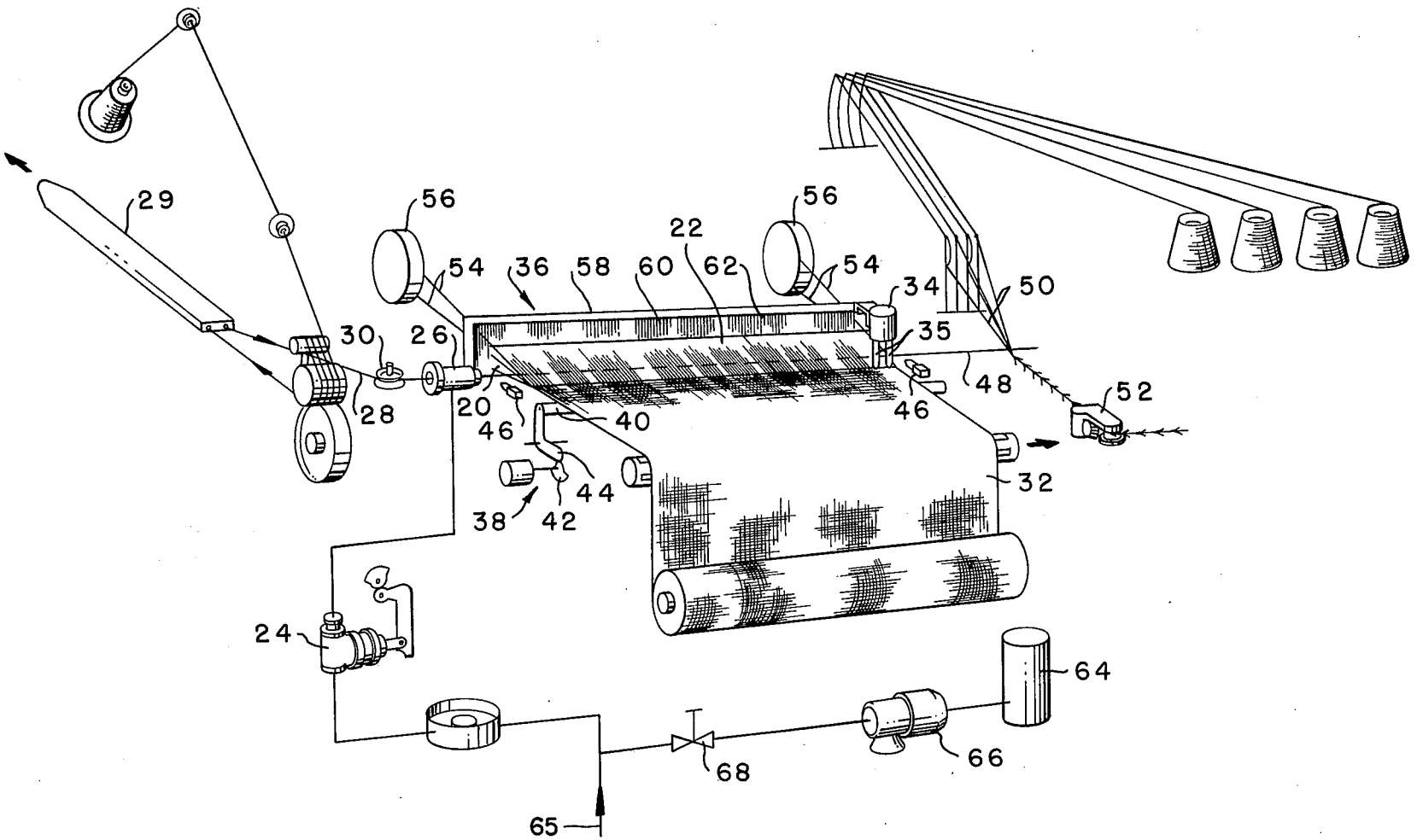
52
50
48
32
64
66
34
35
46
54
56
62
22
60
68
58
40
44
42
36
38
20
26
28
30
24
65
29

WATER JET LOOM

The loom is one of man's oldest inventions. It would seem that such an ancient device would be fully perfected but progress in the weaving arts has been slow. Despite the efforts of such luminaries as Leonardo da Vinci, automatic shuttle return was not perfected until the 1730's and even after Cartwright conceived the modern power loom in 1786, it took over 20 years for the power loom to prove its advantages over the hand loom, in fact in 1813 there were only about 100 power looms in operation in England. After power looms came into common usage, improvements continued but the speed of power looms with shuttles was limited by the need to reverse the shuttle since the power required to drive the shuttle is proportional to the cube of the speed of the loom. In an effort to overcome this limitation, fluid jet looms have been developed which use a jet of fluid to insert the weft.

The most commonly used fluids in jet looms are air and water. Water jet looms can generally be operated at higher speeds and generally produce higher quality fabrics than air jet looms, but stainless steel is required for many parts to prevent corrosion, in particular, the reed which is used for beating the weft into the shed is generally made of stainless steel and must be replaced frequently when abrasive yarns are used. The abrasiveness of most yarns is determined by the amount of titanium dioxide which is dispersed within the yarn in order to deluster or dull the yarn. While other dulling agents such as the oxides of aluminum and barium sulfate are often used, titanium dioxide is the most commonly used even though it is particularly troublesome because of its extreme hardness. The yarns which contain no titanium dioxide are generally referred to as bright while semi-dull yarns contain relatively small amounts of titanium dioxide, mid-dull yarns contain more titanium dioxide while dull or full-dull yarns contain relatively large amounts of titanium dioxide. It has been found that the reed wear problem is most pronounced with mid-dull and full-dull yarns while semi-dull and bright yarns produce very little discernible wear. It has generally been thought that reed wear is due to the abrasive effect of the yarn upon the stainless steel reed. One of the most effective methods of alleviating the problem has been to cause the point of impact to the reed with the weft to vary slightly as the fabric is being woven by providing a reed protection device which raises and lowers the fabric slowly during the weaving process. It has now been found that the problem of reed wear may be further alleviated by providing a means for providing an alkaline solution of the feed water to the jet so that the pH of the water in the jet will be higher than 7.5 and preferably no less than 8.0. The upper limit on the pH is determined principally by considerations of safety rather than by effectiveness and water having a pH of 10.2 has been used with very satisfactory results. Why the use of alkaline water prevents reed wear is not fully understood but it is clear that more than simple prevention of corrosion is involved since stainless steel is generally considered to be extremely corrosion resistant and further since reed wear is a problem principally with mid-dull and full-dull yarns and not with semi-dull and bright yarns. If corrosion prevention alone were involved it should make no difference which type of yarn was being woven.

It had further been found in at least one mill in France that reed wear could be reduced somewhat by using deionized water in the jet. This approach, however, prevents the use of electrical yarn detectors since deionized water is nonconductive, and thus limits the speed of the loom if the relatively slower mechanical yarn detectors are used. Further, deionization of water is relatively expensive as compared to the simple addition of a base to the feed water.

Some water jet weaving yarns require warp sizes which are relatively insensitive to water in the weaving process but which can be easily removed in the finishing process. Size manufacturers have developed special sizes especially for water jet weaving which are proprietary but are generally described as being polyacrylic acid derivatives which are applied to the warp yarns in the ammonium salt form and then dried to a relatively water insensitive acid form in a slashing operation. They are removed in the finishing process by hot scouring at elevated pH using sodium bicarbonate, sodium carbonate or sodium hydroxide solution. Therefore, the use of any of the above-mentioned bases in the water jet itself would normally be expected to interfere with the weaving process especially since the performance and the amount of size applied to water jet warp is more critical than in standard shuttle weaving. In many cases, when standard alkaline soluble size material are used with neutral water enough size will build up on the reed in less than 24 hours to cause broken ends and other defects and the loom will have to be stopped and cleaned. However, suprisingly, it has been found that the addition of sodium bicarbonate to the water supply of the loom enables it to be operated without further cleaning while keeping the reed clean without interferring with the action of the size upon the warp yarn.

The illustration is a schematic showing the operation of a water jet loom incorporating the present invention.

In the illustration, shed 20 is formed by displacing certain selected yarns of the warp 22 vertically by means of heddles (not shown), jet pump 24 forces pulses of water from jet nozzle 26 which withdraws weft yarn 28 from suction tube 29 and forces it into shed 20. When weft yarn 28 has fully traversed the width of fabric 32, gripper 30 grips weft yarn 28 and allows it to begin to accumulate in suction tube 29, and simultaneously reed 36 moves forward to beat weft yarn 28 into shed 20. If weft yarn 28 has fully traversed warp 22 it is sensed by yarn detector 34 which has a pair of electrical contacts 35 which contact the wet weft yarn 28. While mechanical yarn detectors are used in some water jet looms, electrical yarn detectors such as shown here are preferred since they allow the loom to achieve higher operating speeds. The electrical weft detector operates by sensing the slight conductivity of the water on the wet weft yarn as it contacts both contacts 35 of yarn detector 34. Should weft yarn 28 fail to achieve a complete traversal of the warp of the loom, no signal will be passed along the wet weft yarn between contacts 35 and an automatic shut-off mechanism (not shown) will stop the loom until an operator can remedy the problem.

Reed 36 comprises a frame 58 and a plurality of flattened stainless steel wires 60 forming dents 62 through which warp yarns 22 pass. The location at which weft yarn 28 contacts the flattened wires 60 of reed 36 may be varied by providng reed protection device 38 here shown comprising fabric support bar 40 connected to cam 42 by linkage 44. As cam 42 is rotated, linkage 44 moves fabric support bar 40 vertically varying the point of impact of reed 36 with weft yarn 28 as it is beat into position in shed 20. Reed 36 also forces weft yarn 28 against knives 46 which sever its weft yarn 28. Leading end 48 of weft yarn 28 passes between catch cords 50 which are twisted by catch cord spindle 52 causing catch cords 50 to trap and retain leading ends 48. Selvedges are formed on fabric 32 by the action of leno yarns 54 which issue from leno yarn dispensers 56 which rotate about their axis enabling leno yarns 54 to lock each weft yarn 28 into place.

The alkalinity of the feed water supplied to jet nozzle 26 is increased by mixing a solution of sodium bicarbonate and water stored in tank 64 with the normal water supply entering through line 65. The amount of sodium bicarbonate solution mixed with incoming water is controlled by control valve 68 and pump 66. Since sodium bicarbonate forms a buffered solution in water, concentration measuring apparatus is not normally required to maintain the alkalinity of the feed water to the jet within the desired limits.

While the above is a description of the invention as applied to one water jet loom, it is to be understood that the method of the present invention is applicable to those water jet looms which have stainless steel reeds and that the method of the present invention is not limited solely to the water jet loom described above. Using the looms and processes known to the prior art when semi-dull or bright yarn are being woven, reed wear appears to be a very minor problem and the reed needs to be changed only infrequently. But with mid-dull yarns, the reed will usually require changing after the production of on the order of 5,000 yards of fabric if a reed protection device is installed and neutral, electrically conductive water is supplied to the loom being used. The life of the reed may be increased greatly by adding an effective amount of the base to the feed water to the jet, to raise the pH of the feed water to above at least 7.5, more preferably in the range of 8.0 to 10.5 although the upper limit on pH is determined principally by safety considerations and not by effectiveness. Any base which does not interfere with the operation of the loom or damage the fabric may be used but it is greatly preferred that the base be used be such that a buffered solution having a pH in the range of 8.0 to 9.5 may be obtained without the need of pH measuring or controlling apparatus. Therefore, the bases which are preferred for the practice of the present invention are those having a conjugate acid whose $pk_a$ is above 7.5 and more preferably is in the range of 8.0 to 9.5. The preferred base for the practice of the present invention is sodium bicarbonate since rather large variations in the amount of sodium bicarbonate used produce relatively small variations in the pH of the feed water to the jet. For example, using neutral unbuffered water from a municipal water treatment source, the addition of from about 10 parts per million up to about 1,000 parts per million of sodium bicarbonate will normally yield a pH in the range of 8.0 to 8.2. Thus, relatively large variations in the amount of sodium bicarbonate introduced into the water can be tolerated while still maintaining the pH within the desired range. When alkaline feed water is used for water jet looms, as mentioned before, an unexpected bonus is obtained because the size materials which are used for the warp yarns on water jet looms are generally insoluble in neutral water but are soluble in hot alkaline solutions. Unexpectedly, in the case of alkali soluble sizes, the use of alkaline feed water within the limits of this invention does not interfere with the protection of the warp yarns given by the size but does contribute to keeping the loom clean by reducing the build-up of size on the reed and heddles.

The following Examples are provided to more fully illustrate the invention and the problems it solves. Unless otherwise stated, all Examples were performed on Nissan Model LW-51 water jet looms having reeds of T-430 stainless steel. Where a LW-51-150CM loom is mentioned, it is to be understood that a reed protection device was used unless otherwise specified. The 210CM loom is not equipped with a reed protection device.

On these looms as on many other water jet looms when the reed becomes significantly worn, it is not necessary to replace the reed but rather three other positions of wear on the reed can be used. For example, the reed, which is symmetrical, can be turned upside down to use as the top of the reed what was previously the bottom and this procedure can be repeated for both faces of the reed making a total of four points of impact on the reed which can be used before the reed must be discarded. When it is specified in the following examples that a reed has been changed, it should be understood that the reed has been removed and reinstalled in a new position such that a new point of impact between the reed and the weft yarn is used.

Unless otherwise specified, the yarn is not textured. The following Examples are meant only to more fully illustrate the invention and its application to water jet looms and are not to be interpreted to limit the invention which is defined solely by the claims.

EXAMPLE I

Fabric was produced on a Nissan LW-51 210CM water jet loom using 2-ply, 150 denier, 34 filament semi-dull unsized textured polyester and neutral feed water. After more than 100,000 yards of material had been produced, there was no significant wear on the reeds when neutral water was used as the feed for the jet.

EXAMPLE II

The procedure of Example I was repeated on a Nissan LW-51 150CM water jet loom. After 10,000 yards of material had been produced, there was no significant wear on the reed.

EXAMPLE III

Fabric was produced on a Nissan LW-51 210CM loom using sized 70 denier, 17 filament semi-dull flat yarn, type 6 nylon and neutral feed water. After 30,000 yards of fabric were produced, the reed was worn to the extent that it interfered with weaving.

EXAMPLE IV

The procedure of Example III was repeated on a Nissan LW-51 150CM water jet loom. After more than 50,000 yards of material were produced, very little wear was observed on the reed.

EXAMPLE V

Fabric was produced on a Nissan LW-51 150CM loom using 70 denier, 17 filament, unsized mid-dull type 66 nylon warp yarn. The reed had to be changed after 6,000 yards of fabric had been formed.

EXAMPLE VI

The procedure of Example V was repeated on a Nissan LW-51 150CM loom without a reed protector and after 1,000 yards of fabric had been produced, the reed was severly worn and had to be changed.

EXAMPLE VII

Fabric was produced on a Nissan LW-51 150CM loom using 70 denier, 17 filament unsized mid-dull type 66 nylon for the warp yarn. 70 denier, 34 filament unsized mid-dull type 66 nylon was used for the filling. The water supply to the jet had 120 parts per million of sodium bicarbonate added to yield a pH between 8.0 and 8.2. After 7,500 yards of fabric were produced the reed showed very slight reed wear, far less than that which would interfere with weaving. It should be noted that Example VII is the same as Example V except for the use of alkaline feed water to the jet; the dramatic decrease in the wear on the reed should be noted.

EXAMPLE VIII

The procedure of Example VII was continued until 18,000 yards of fabric had been produced at which time the reed was inspected and showed no significant wear and was considered suitable for extended further use without changing.

EXAMPLE IX

The procedure of Example VII was continued except that the sodium bicarbonate was omitted from the feed water to the jet which had a pH of between 7.0 and 7.5. After 7,500 yards of fabric had been produced, the reed was worn to the extent that it interferred with weaving by breaking warp yarns by abrasion.

EXAMPLE X

The procedure of Example IX was repeated with another reed except that neutral feed water having a pH of between 7.0 and 7.5 was used. The reed was severly worn after 6,000 yards of material were produced and required changing.

EXAMPLE XI

Fabric was produced on a Nissan LW-51 150CM water jet loom using 70 denier, 17 filament mid-dull type 66 nylon warp yarn. 30 parts per million of sodium carbonate were added to the feed water to yield a pH of between 9.0 and 9.5. After 6,000 yards of fabric were woven, the reed protection device was disconnected and 4,000 more yards of fabric were produced. When the reed was inspected, it showed only slight wear and was judged suitable for extended further use.

EXAMPLE XII

The procedure of Example XI was repeated except that neutral feed water was used and the reed protection device was disconnected from the beginning. The reed required changing before 1,000 yards of material had been produced.

EXAMPLE XIII

Fabric was produced on a Nissan LW-51 150CM water jet loom. The feed water was treated by passing it through water softening column followed by a strong base anion column. This replaced the ions in the incoming water with sodium hydroxide yielding water with a pH of 10.0 to 10.3. Reed wear was greatly decreased as compared to a water jet loom using neutral feed water. In excess of 30,000 yards of material was produced without detrimental wear on the reed.

As our invention, we claim:

1. In a method of weaving in which the weft is fed by a water jet and wherein the alkalinity of the water is normally below a pH of 8.0, the improvement comprising increasing the alkalinity of the water a pH of at least 8.0 prior to its passage through the jet.

2. In a method of weaving in which the weft is fed by a water jet and wherein the alkalinity of the water is normally below a pH of 7.5, the improvement comprising increasing the alkalinity of the water to a pH of at least 7.5 prior to its passage through the jet.

3. The method of claim 2 wherein the alkalinity of the water is increased by introducing a base into the water, said base having a conjugate acid having a $pk_a$ of at least 7.5.

4. The method of claim 2 wherein the alkalinity of the water is increased by introducing a base into the water, said base having a conjugate acid having a $pk_a$ of between about 8.0 and 9.5.

5. The method of claim 4 wherein said base is sodium bicarbonate and wherein the amount of sodium bicarbonate introduced is at least about 10 parts per million.

* * * * *